US005184584A

United States Patent [19]

Cantrell

[11] Patent Number: 5,184,584

[45] Date of Patent: Feb. 9, 1993

[54] REMOTE STARTER FOR ALARM SYSTEM EQUIPPED VEHICLES

[75] Inventor: Harold S. Cantrell, Knoxville, Tenn.

[73] Assignee: C & A Control Systems, Inc., Knoxville, Tenn.

[21] Appl. No.: 807,723

[22] Filed: Dec. 16, 1991

[51] Int. Cl.[5] ..... F02N 11/08

[52] U.S. Cl. ..... 123/179.2; 307/10.5

[58] Field of Search ..... 123/179.2, 179.3, 146.5 B, 123/198 B; 307/10.3, 10.5

[56] References Cited

U.S. PATENT DOCUMENTS 4,148,372 4/1979 Schroeder ..... 123/146.5 B
4,236,594 12/1980 Ramsperger ..... 123/179.2
4,296,402 10/1981 Szczepanski ..... 123/179.3
4,345,554 8/1982 Hildreth et al. ..... 123/179.2

*Primary Examiner*—Andrew M. Dolinar
*Attorney, Agent, or Firm*—Pitts and Brittian

[57] ABSTRACT

An electrical system for bypassing the anti-theft system of a vehicle such that the engine can be started with a remote control. In particular, this is a system which allows the operator of a vehicle to start the vehicle from a remote location without having the key in the ignition and without alarming the vehicle's anti-theft device. Activation of the remote control which throws a switch, bypasses the normal key dependant ignition circuitry. A potentiometer in the bypass loop mimics the resistance pellet embedded in the ignition key, which is normally required for engaging the engine without alarming the anti-theft device. Other portions of an anti-theft system can also be bypassed if desired.

7 Claims, 1 Drawing Sheet

REMOTE STARTER FOR ALARM SYSTEM EQUIPPED VEHICLES

TECHNICAL FIELD

This invention relates to electrical circuitry for the ignition system of a vehicle and, more particularly, it relates to circuitry for starting the engine of the vehicle with a remote control, without activating the anti-theft system of the vehicle.

Anti-theft alarm systems have become very common in modern vehicles, especially in the more expensive models. These systems have increased in complexity over the years due to the addition of motion sensors, shock sensors, verbal warning devices, and other components. Some systems also include amenities for the vehicle operator, such as automatic locking and unlocking of the doors and trunk when the alarm system is energized and de-energized, respectively, automatic closing of all windows and the sunroof upon system energization, and automatic system reset if the alarm is activated for more than a specific period of time.

One of the factory installed security systems is the VATS-Pass Key system as utilized in certain General Motors Corporation vehicles. In such a system there is a resistor pellet (of specific resistance) in the ignition key, with a decoder in the ignition system to "read" the resistance value. Only if there is a correct resistance match will the ignition system be activated by the key.

As helpful as many of these systems have become, none have given the vehicle operator the ability to start the vehicle with a remote control. This feature is beneficial in cold weather when the operator wants to start the engine and warm up the vehicle before going outside.

It is therefore an object of the present invention to provide circuitry such that the engine of a vehicle may be started by remote control.

It is a further object of the invention to allow the remote starting of the engine without activating the anti-theft alarm system in the vehicle.

Another object of the present invention is to provide for the remote starting of an engine in a vehicle equipped with a VATS-Pass Key security system without activating that security system.

These and other objects of the present invention will become apparent upon a consideration of the drawings referred to hereinafter and the complete description thereof.

DISCLOSURE OF THE INVENTION

In accordance with the present invention, there is provided circuitry which allows for the starting of the engine of a vehicle by remote control. The remote starting system bypasses the normal ignition system, allowing the engine to start without activating the anti-theft device of the vehicle. In those anti-theft systems utilizing a resistance pellet in the ignition key, the circuitry of the present invention includes a resistance to mimic the pellet. The system will also disable any other component of the anti-theft system, such as motion sensors, and ignition inputs that may be alarmed upon engine activation.

BEST MODE FOR CARRYING OUT THE INVENTION

Figure 1:
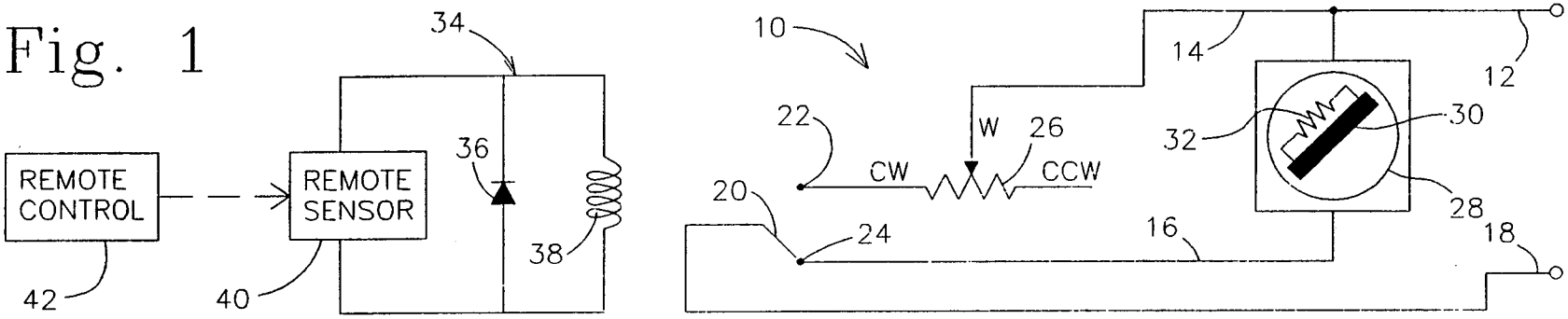
FIG. 1 is a schematic diagram illustrating the components and the connections therein for a system for starting the engine of a vehicle with a security system from a remote location without energizing that security system.

A device constructed in accordance with various features of the invention is shown at 10 in FIG. 1. More specifically, the device comprises switching means 20, an ignition line 16, a bypass line 14, and an activation device 34. The position and function of each component will be discussed in detail.

The ignition line 16 comprises a wire and an ignition lock cylinder 28, while the bypass line 14 comprises a wire and a potentiometer 26. Typically, this potentiometer 26 has a total resistance of approximately 0–50 kilo-ohms. Both lines 14 and 16 are electrically connected in parallel such that one end of each is connected to a pass key wire 12 and the other end of each is connected to switch 20. Switch 20 is further connected to a second pass key wire 18, such that switch 20 must choose whether the ignition line 16 or the bypass line 14 will complete the circuit with the pass key wires 12, 18. These pass key wires 12, 18, as will be known to those versed in the art, connect the ignition cylinder 28 between the vehicle power source and the engine starting system. Switch 20 is under the influence of the activation device 34 which comprises a relay 38, which is electrically connected in parallel to diode 36. The activation device 34 is connected to a remote sensor 40 such that energization of a remote control 42 by a user will energize the activation device 34 via the sensor 40.

In the preferred embodiment, this system 10 will be used in conjunction with the VATS-Pass Key anti-theft alarm system as developed by the General Motors Corporation. This anti-theft system works in such a way that a resistor pellet 32 is embedded in every ignition key 30 of vehicles equipped with the VATS-Key system. The pellet 32 of each individual vehicle is associated with a resistance value unique to that vehicle. If attempts are made to start a car equipped with the VATS-Pass Key system without the required resistance 32 in place, either from lack of a key or from incorrect key resistance, the alarm is programmed to activate.

Since the ignition cylinder 28 is connected between the vehicle's power source and the vehicle's starter system, a current must flow through the pass key wires 12, 18 for the ignition system to start the engine. Under normal operation of the ignition system, a key 30 is inserted into the ignition lock cylinder 28 and twisted. Current then flows through the resistor pellet 32 on the key 30, thus completing the circuit through lines 12 and 18. A decoder module "reads" the pellet to determine the resistance 32 thereof. If the key 30 is not used, or if the resistance value of the pellet 32 is incorrect, as determined by the decoder module, the anti-theft alarm will activate.

With the new system 10 installed, as shown in FIG. 1, both normal and remote starting of the engine is possible. If switch 20 is in position 24 and the correct ignition key is used in the ignition lock cylinder 28, the system 11 will perform as described above. If the remote control 42 is used, upon activation of the remote 42, a remote sensor 40 will send a signal to relay 38. Relay 38 will then energize, causing switch 20 to move to position 22. The closing of the circuit through line 14 will allow current to flow through potentiometer 26. Potentiometer 26 must be preset before installation of the system 10 to exactly match the resistance value of the pellet 32 on the ignition key 30 for the specific vehicle. The required current has now been supplied through the bypass line 14, with the necessary resistance 26 in place, thus the engine will start without activating the anti-theft system. Deactivation of the remote will cause relay 38 to de-energize. Switch 20 will then move back to position 24, the engine will stop, and the circuit will be reset.

Figure 2:
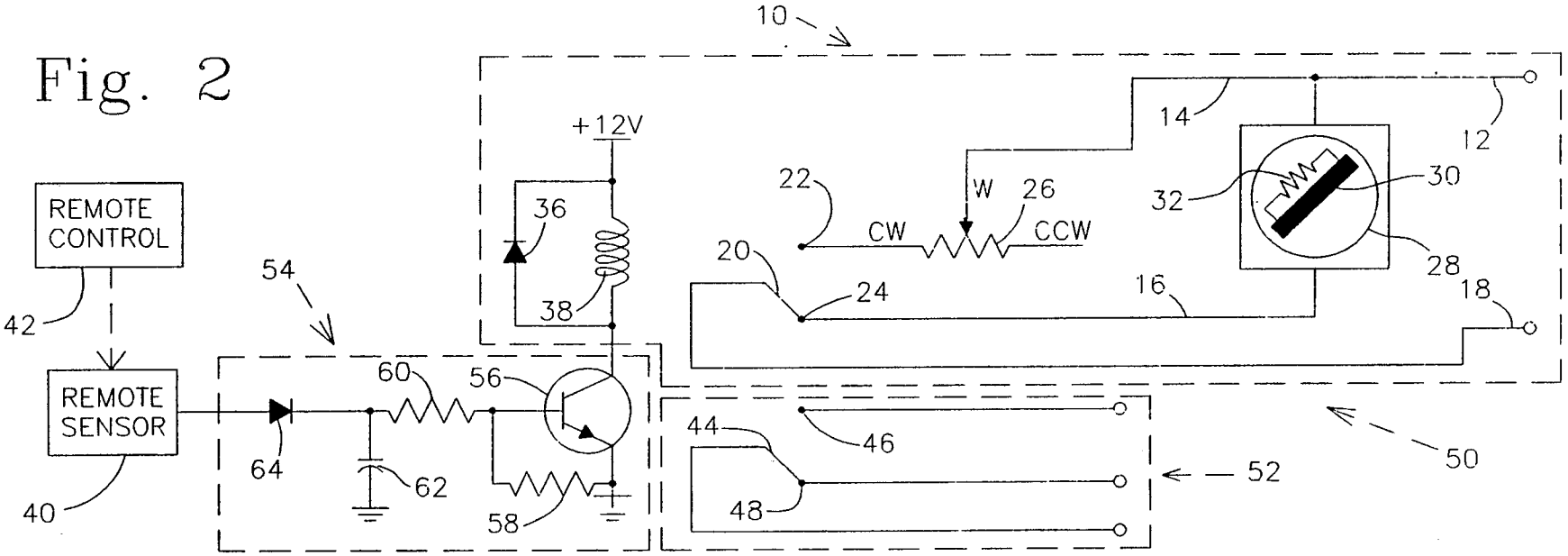
FIG. 2 is a schematic diagram illustrating the system of FIG. 1 further comprising elements for controlling additional components of the security system and for delaying the de-activation of the engine once the remote has been de-energized.

Another embodiment of the invention 50 is shown in FIG. 2. In this embodiment, a supplemental switching unit 52 and a de-energization control device 54 have been added to the system 10. This embodiment 50 utilizes the same circuit 10 shown in FIG. 1, which operates in the exact manner described above. The supplemental switching unit 52 has been added for connection to additional components of the anti-theft system, thus providing increased control over the anti-theft system. The de-energization control device 54 will alter the time between when the remote control 42 is deactivated and when the switching device 38 in the system 10 is de-energized. The supplemental switching unit 52 and de-energization device 54 will be discussed in further detail.

Additional lines within the supplemental switching unit 52 may be attached to any other part of the anti-theft system over which the operator needs control. Components such as a motion sensor, shock sensor or ignition inputs can be attached to the leads in the switching unit 52. Switch 44 in this unit 52 operates in the same manner as switch 20. If relay 38 is energized, switch 44 moves from position 48 to 46, and from 46 to 48 when relay 38 is de-energized. Switch 44 gives the operator control over when secondary components of the alarm system are energized.

The de-energization control device 54 delays the time between when the remote control 42 is de-activated and when relay 38 is de-energized. Activation of the remote 42 will cause a current to pass through diode 64. This current will charge capacitor 62 and energize transistor 56. Once transistor 56 starts conducting, relay 38 will be energized, thus moving switches 20 and 44. The movement of the switches 20, 44 will allow the engine to start as described previously. When the remote 42 is deactivated, the current through diode 64 will cease. Capacitor 62 will then discharge its stored energy, thus maintaining the current through transistor 56. After a certain interval, dependant upon the value of capacitor 62, the voltage applied to transistor 56 will drop below a threshold voltage, and transistor 56 will stop conducting current. The de-energization of transistor 56 will cause relay 38 to de-energize, thus resetting switches 20 and 44 to positions 24 and 48, respectively.

The combination of the supplemental switching unit 52 and the de-energization control device 54 permits the operator to energize and de-energize other parts of the anti-theft system as required. A motion sensor for example, would be alarmed by the vibrations created by the starting and running of the engine. By preventing the signal from this sensor from reaching the alarm system, a false alarm can be prevented. Thus, any components of the alarm system that must be disarmed during engine activation should be connected through the supplemental switching unit 52.

From the foregoing detailed description it will be recognized by a person skilled in the art that a system for activating the engine of a vehicle by remote control has been shown and described. The system is particularly useful in that it will bypass the anti-theft system of the vehicle to prevent an alarm from activating. The invention provides vehicle operators a much needed convenience. Although the system has been specifically described for security systems using a resistance element in the ignition key, it will be recognized that if any other type of security element is used in the key, the by-pass circuit around the ignition switch would include an element that emulates the performance of the security element.

While a preferred embodiment has been shown and described, it will be understood that there is no intent to limit the invention to such disclosure, but rather it is limited by that description in combination with the appended claims and their equivalents.

I claim:

1. An electrical control system for remotely starting an engine of a vehicle where said vehicle has an engine starting circuit including an ignition switch operated by a key, a power source, an engine starter, electrical connections between said power source and said engine starter and an anti-theft security system including an anti-theft security element associated with said ignition switch and key, said electrical control system comprising:

a bypass circuit for said ignition switch, said bypass circuit including a switch means and a simulated security element in series with said switch means, said simulated security element emulating operation of said anti-theft security element;

a remote operator means for use by a user of said control system; and a remote sensor means energized by said remote operator means including means for operation of said switch means whereby said control system is energized by said remote operator means to activate said starting system of said vehicle engine without energizing an alarm associated with said anti-theft security element.

2. The control system of claim 1 wherein said anti-theft security element is a resistance element mounted in a key to operate said ignition switch and a decoder module in said starting circuit, and wherein said simulated security element is a resistance means having a resistance value substantially equal to a resistance value of said resistance element.

3. The control system of claim 2 wherein said resistance means is an adjustable resistance unit whereby resistance of said resistance means is adjustable to be substantially equal to said resistance value of said resistance element mounted in said key.

4. The control system of claim 1 further comprising:

at least one further switch means operated by said means of said remote sensor means; and circuit means connecting said at least one further switch means to additional components of said anti-theft security system whereby closure of said at least one further switch means de-energizes said additional components of said anti-theft security system such that starting of said engine does not energize said additional components.

5. An electrical control system for remotely starting an engine of a vehicle where said vehicle has an engine starting source, an engine starter, electrical connections between said system including a resistance element mounted in a key to operate circuit, said electrical control system comprising:

a bypass circuit for said ignition switch, said bypass circuit including a switch means and a resistance means in series with said switch means, said resistance means having a resistance value substantially equal to said resistance element of said anti-theft security element;

a remote operator means for use by a user of said control system; and a remote sensor means energized by said remote operator means including means for operation of said switch means whereby said control system is energized by said remote operator means to activate said starting system of said vehicle engine without energizing an alarm associated with said anti-theft security element.

6. The control system of claim 5 wherein said resistance means is adjustable to provide a resistance value substantially equal to said resistance element of said anti-theft security system.

7. The control system of claim 5 further comprising:

at least one further switch means operated by said means of said remote sensor means; and circuit means connecting said at least one further switch means to additional components of said anti-theft security system whereby closure of said at least one further switch means de-energizes said additional components of said anti-theft security system such that starting of said engine does not energize said additional components.

* * * * *